US010851985B2

(12) United States Patent
Shin et al.

(10) Patent No.: US 10,851,985 B2
(45) Date of Patent: Dec. 1, 2020

(54) LED MODULE AND LED LIGHTING DEVICE COMPRISING SAME

(71) Applicant: AMOSENSE CO.,LTD, Cheonan-si (KR)

(72) Inventors: Gyu-Weon Shin, Daejeon (KR); Sang-Ho Ma, Seoul (KR)

(73) Assignee: Amosense Co., Ltd., Cheonan-Si (KR)

( * ) Notice: Subject to any disclaimer, the term of this patent is extended or adjusted under 35 U.S.C. 154(b) by 0 days.

(21) Appl. No.: 16/607,417

(22) PCT Filed: Apr. 11, 2018

(86) PCT No.: PCT/KR2018/004232

§ 371 (c)(1),
(2) Date: Oct. 23, 2019

(87) PCT Pub. No.: WO2018/199517

PCT Pub. Date: Nov. 1, 2018

(65) Prior Publication Data

US 2020/0124267 A1 Apr. 23, 2020

(30) Foreign Application Priority Data

Apr. 27, 2017 (KR) ..... 10-2017-0054180

(51) Int. Cl.
*F21V 29/71* (2015.01)
*F21V 29/15* (2015.01)
(Continued)

(52) U.S. Cl.
CPC ..... *F21V 29/713* (2015.01); *F21V 29/15* (2015.01); *F21V 29/763* (2015.01); *F21V 29/83* (2015.01); *F21V 29/87* (2015.01); *F21Y 2115/10* (2016.08)

(58) Field of Classification Search
CPC ..... F21V 29/713; F21V 29/15; F21V 29/763; F21V 29/83; F21V 29/87; F21V 5/007;
(Continued)

(56) References Cited

U.S. PATENT DOCUMENTS 5,898,530 A 4/1999 Braun
2011/0175529 A1* 7/2011 Hayashi ..... F21S 41/19 315/77
(Continued)

FOREIGN PATENT DOCUMENTS

JP 2012146425 A * 8/2012 ..... B23K 9/173
JP 2012146425 A 8/2012
(Continued)

OTHER PUBLICATIONS

Machine English Translation of KR10-1199592B1 (Korea Institute of Industrial Technology) Nov. 12, 2012 (Year: 2012).*
(Continued)

*Primary Examiner* — Rajarshi Chakraborty
*Assistant Examiner* — Glenn D Zimmerman
(74) *Attorney, Agent, or Firm* — Rothwell, Figg, Ernst & Manbeck, P.C.

(57) ABSTRACT

An LED module that includes a light source unit which includes one or more LEDs mounted on one surface of a circuit board, a heat sink which includes a base substrate configured to support the light source unit and radiate heat generated from the light source unit and an insulating heat radiation coating layer applied on an outer surface of the base substrate, a protective cover which includes a convex portion formed in a region corresponding to the LED and is coupled to one surface of the heat sink to protect the light source unit from an external environment, an air flow space formed between the light source unit and the protective cover and provides a space through which air can flows, and
(Continued)

one or more air vents which perform a function as a passage through which the air is moved to the outside from the air flow space and balance internal pressure of the air flow space with pressure of outside air.

14 Claims, 10 Drawing Sheets

(51) Int. Cl.
*F21V 29/76* (2015.01)
*F21V 29/83* (2015.01)
*F21V 29/87* (2015.01)
*F21Y 115/10* (2016.01)

(58) Field of Classification Search
CPC ..... F21V 31/03; F21V 29/70; F21Y 2115/10; F21K 9/20
See application file for complete search history.

(56) References Cited

U.S. PATENT DOCUMENTS

2011/0317420 A1* 12/2011 Jeon ..... F21V 29/763 362/249.02
2012/0188766 A1* 7/2012 Lu ..... F21V 29/83 362/249.02
2012/0212960 A1* 8/2012 Rodriguez ..... F21V 29/67 362/249.02
2017/0051911 A1 2/2017 Xie
2020/0154608 A1* 5/2020 Kim ..... C09D 7/40

FOREIGN PATENT DOCUMENTS

JP 2013125679 A 6/2013
KR 101151823 B1 6/2012
KR 101199592 B1 * 11/2012
KR 101199592 B1 11/2012
KR 20130051553 A 5/2013
KR 20140134853 A 11/2014
KR 101689592 B1 * 12/2016
KR 101689592 B1 12/2016
WO WO-2009018193 A1 * 2/2009 ..... C08J 3/005
WO WO-2015177826 A1 * 11/2015 ..... F21V 31/00
WO WO-2017204565 A1 * 11/2017 ..... C09D 201/00

OTHER PUBLICATIONS

Machine English Translation of JP2012-146425A (Inaba) Aug. 2, 2012 (Year: 2012).*
Wikipedia entry on HEPA Filter (Year: 2020).*
Machine English Translation of KR101689592, Kim, Dec. 26, 2016 (Year: 2016).*

* cited by examiner

LED MODULE AND LED LIGHTING DEVICE COMPRISING SAME

CROSS-REFERENCE TO RELATED APPLICATIONS

This application is the national phase entry of International Application No. PCT/KR2018/004232, filed on Apr. 11, 2018, which is based upon and claims priority to Korean Patent Applications 10-2017-0054180, filed on Apr. 27, 2017, the entire contents of which are incorporated herein by reference.

BACKGROUND

The present invention relates to a light-emitting diode (LED) module and an LED lighting device including the same, and more particularly, to an LED module capable of preventing an increase in internal pressure, and an LED lighting device including the same.

Light-emitting diodes (LEDs) may have low power consumption, emit high luminance light, and be used semi-permanently. Accordingly, the LEDs are being used in various lighting devices.

As an example, the LEDs are applied to street lights installed along a roadside for street lighting, traffic safety, or aesthetics. In addition, the LEDs are applied to tunnel lamps for securing a driver's view by being installed in a tunnel.

Such an LED lighting device generally has a structure including a housing made of a material such as metal, i.e., aluminum, ceramic, plastic, or the like, an LED light source disposed on one surface or inside of the housing, and a light transmitting cover coupled to the housing.

However, the LEDs generate a lot of heat when emitting light. Accordingly, air present inside the light transmission cover is heated by the heat generated from the LED. Momentum of the heated air is greater than that of low temperature air, and thus, in a case in which air is heated in a closed space, internal pressure is increased. The internal pressure acts as an external force that presses a portion having a weak coupling force among portions which are mechanically coupled.

Meanwhile, a gasket is disposed in the LED lighting device in order to increase airtightness of a portion which is mechanically coupled. A rubber material is typically used as such a gasket to increase airtightness.

When internal pressure is changed, a gasket disposed at a coupled portion receives repetitive stress due to an increase and a decrease in internal pressure, and a restoring force thereof is decreased with time. For this reason, even when the internal pressure is decreased, the gasket may not be restored to its original state and may maintain the deformed state. Accordingly, the gasket may not perform its function properly.

SUMMARY OF THE INVENTION

The present invention is directed to providing a light-emitting diode (LED) module in which a space formed between a light source unit and a protective cover communicates with the outside, thereby solving a problem in which internal pressure is increased due to an increase in temperature, and an LED lighting device including the same.

In addition, the present invention is directed to providing an LED module in which an insulating heat radiation coating layer is applied on a heat sink, thereby improving heat radiation performance while reducing overall weight, and an LED lighting device including the same.

To solve the above problem, a light-emitting diode (LED) module according to the present invention includes a light source unit which includes one or more LEDs mounted on one surface of a circuit board, a heat sink which includes a base substrate configured to support the light source unit and radiate heat generated from the light source unit and an insulating heat radiation coating layer applied on an outer surface of the base substrate, a protective cover which includes a convex portion formed in a region corresponding to the LED and is coupled to one surface of the heat sink to protect the light source unit from an external environment, an air flow space which is formed between the light source unit and the protective cover and provides a space through which air flows, and one or more air vents which perform a function as a passage through which the air is moved to the outside from the air flow space and balance internal pressure of the air flow space with pressure of outside air.

The protective cover may include one ore more protrusions configured to maintain a distance to the circuit board such that the air flow space is formed when the protective cover is coupled to the heat sink, and the protrusion may be formed to protrude from one surface of the protective cover.

The convex portion may include an accommodation space formed to accommodate the LED on a facing surface thereof which faces the LED, and the accommodation space may communicate with the air flow space. Thus, air heated by heat generated from the LED may flow along the air flow space and then be discharged to the outside through the air vent.

As an example, the air vent may include a movement path formed to pass through the heat sink so as to communicate with the air flow space and a vent member attached to one surface of the heat sink to cover an open upper portion of the movement path.

In another example, the air vent may include a movement path formed to pass through the protective cover so as to communicate with the air flow space and a vent member attached to one surface of the protective cover to cover the movement path.

In still another example, the air vent may include a movement path formed to pass through a cable fixture so as to communicate with the air flow space and a vent member attached to one surface of the cable fixture to cover the movement path.

The air vent may include a vent member having air permeability and moisture permeability. As an example, the vent member may be a membrane, and more specifically, the vent member may be a membrane made of a nanofiber agglomerate.

The insulating heat radiation coating layer may include a coating layer-forming component including a main resin and an insulating heat radiation filler included in an amount ranging from 25 to 70 parts by weight with respect to 100 parts by weight of the main resin. As an example, the insulating heat radiation filler may include silicon carbide.

The light source unit may have a flat plate shape including the circuit board having a plate shape with a certain area and a plurality of LEDs mounted on one surface of the circuit board.

The LED module may be applied to various LED lighting devices.

According to the present invention, an air flow space formed between a light source unit and a protective cover communicates with the outside through an air vent, and thus, pressure in the air flow space can be balanced with external pressure. Thus, according to the present invention, airtightness and a mechanical coupling force can be maintained, thereby securing durability and product reliability.

In addition, according to the present invention, an insulating heat radiation coating layer is applied on a heat sink, thereby improving heat radiation performance while reducing overall weight. Therefore, according to the present invention, it is possible to prevent a decrease in light efficiency caused by degradation and extend a lifespan of a product.

DETAILED DESCRIPTION

Figure 1:
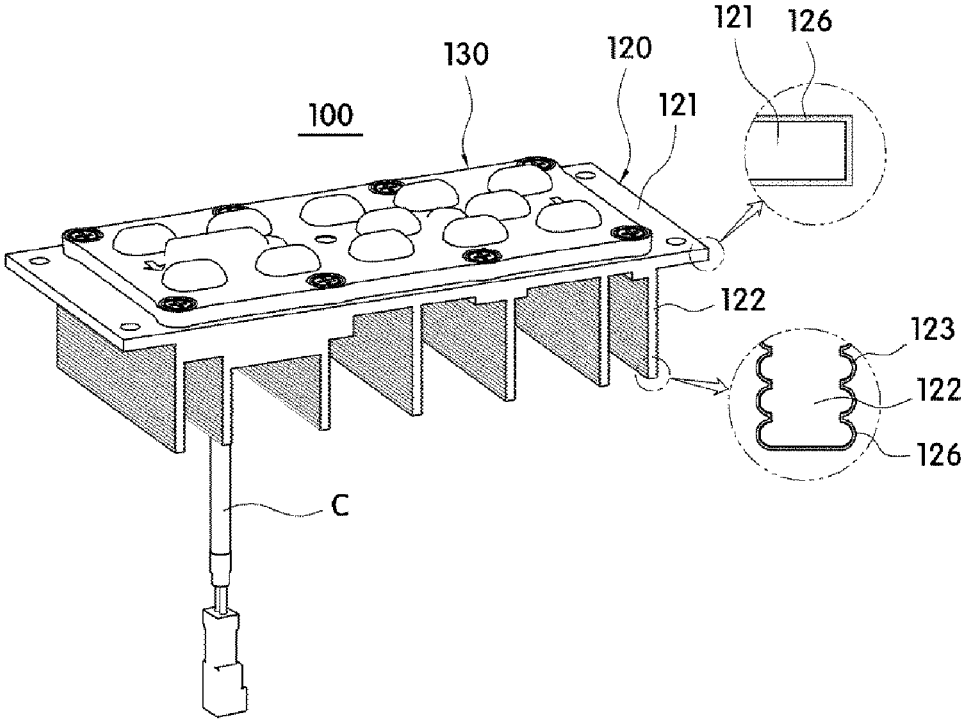
FIG. 1 is a view illustrating a light-emitting diode (LED) module according to one embodiment of the present invention.
Figure 2:
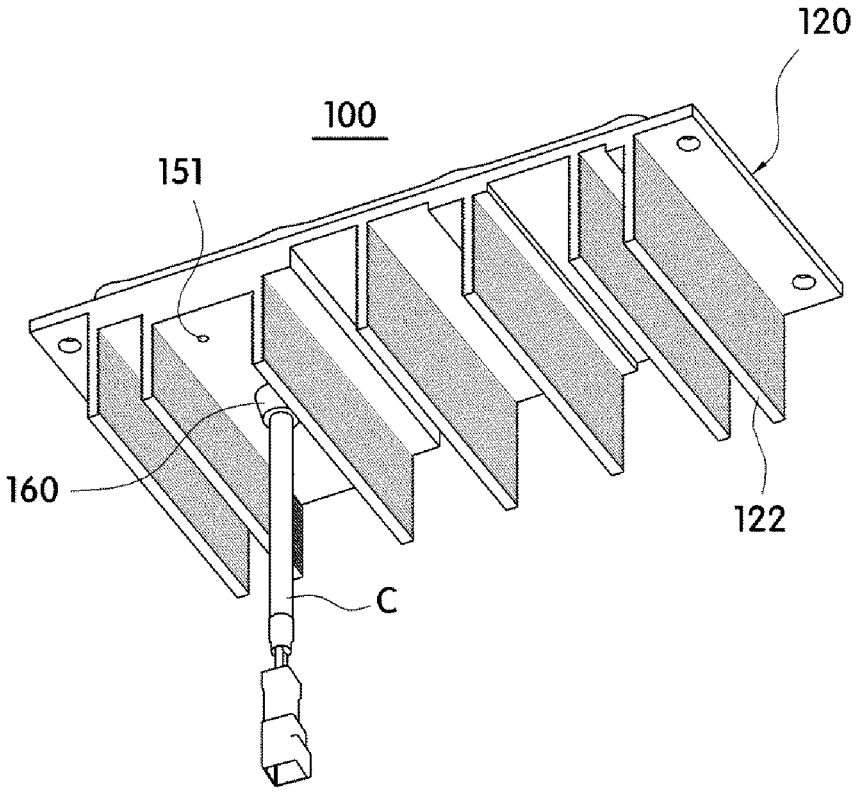
FIG. 2 is a bottom perspective view of FIG. 1.

Hereinafter, embodiments will be described in detail with reference to the accompanying drawings so that that those skilled in the art may easily perform the embodiments of the present invention. The embodiments of the present invention may be implemented in several different forms and are not limited to the embodiments described herein. Parts irrelevant to description will be omitted in the drawings to clearly explain the embodiments of the present invention, and the same parts or similar parts are denoted by similar reference numerals throughout this specification.

Figure 6:
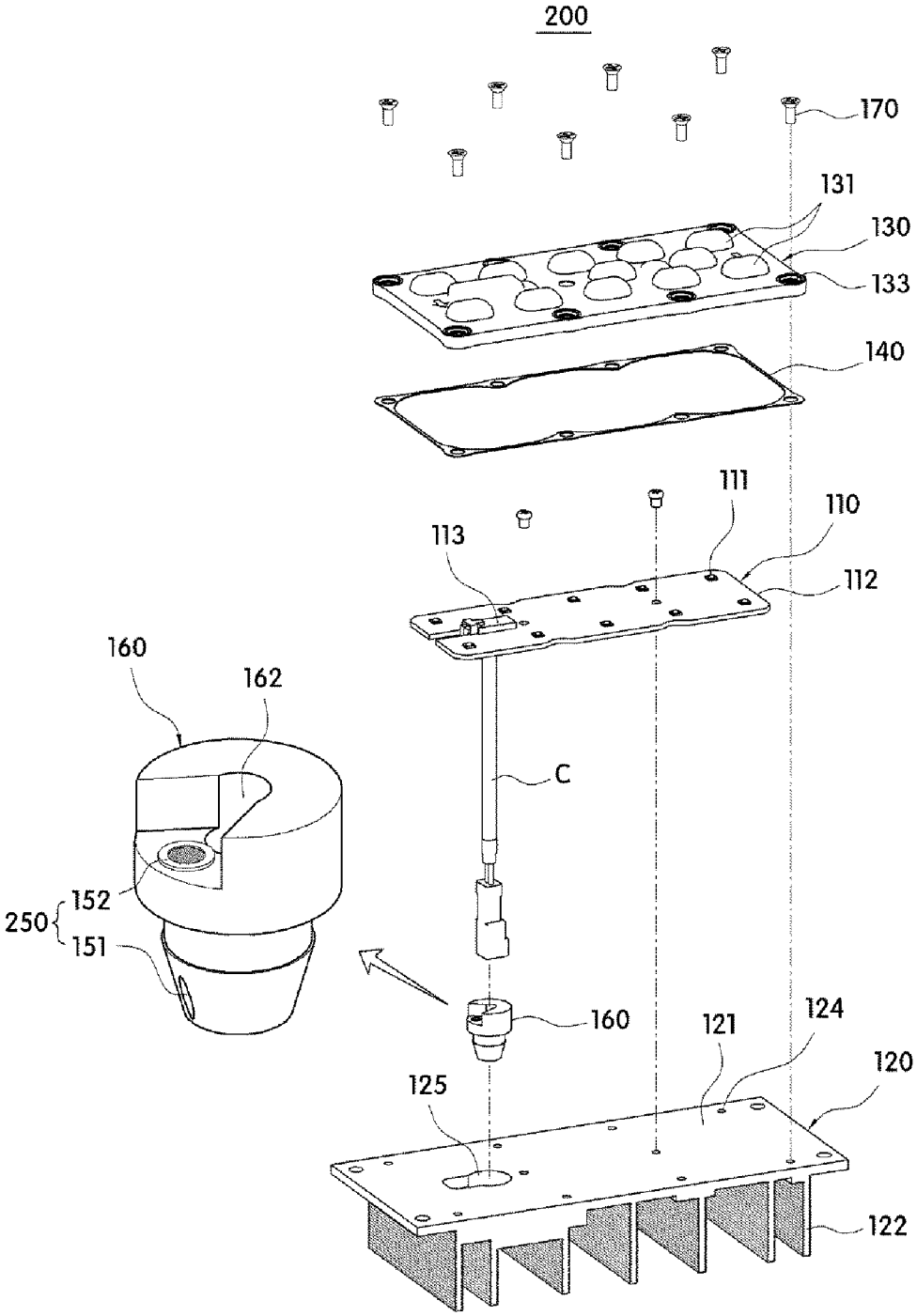
FIG. 6 is an exploded view illustrating an LED module according to another embodiment of the present invention.
Figure 9:
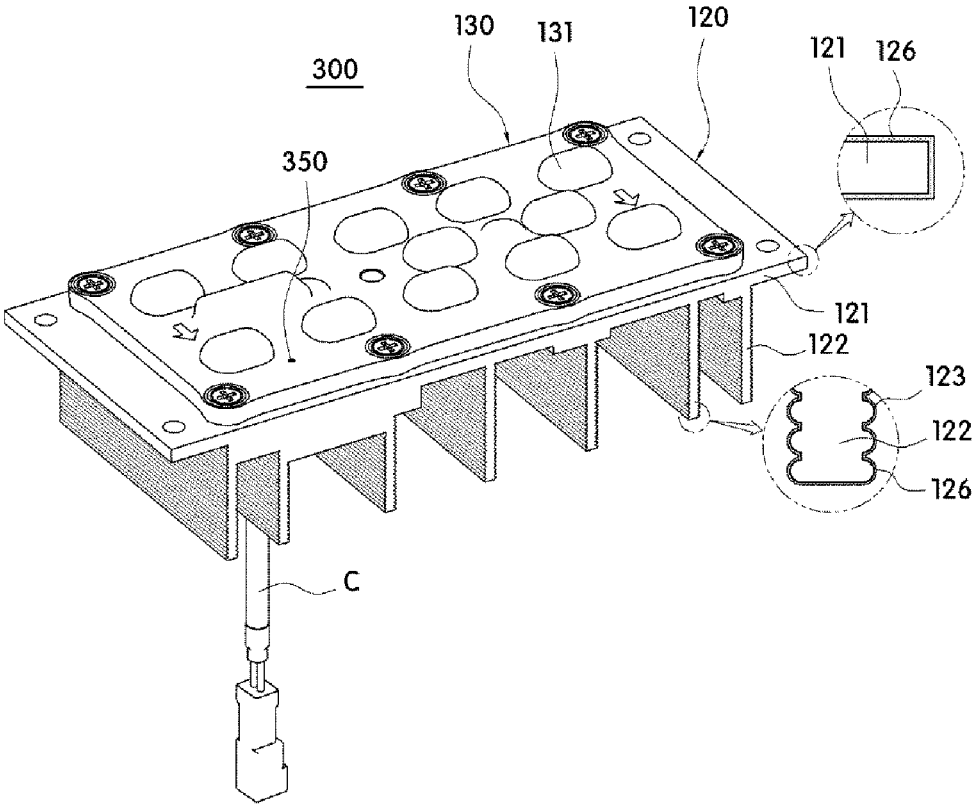
FIG. 9 is a view illustrating an LED module according to still another embodiment of the present invention.

As shown in FIGS. 1, 6, and 9, each of light-emitting diode (LED) modules 100, 200, or 300 according to one embodiment of the present invention includes a light source unit 110, a heat sink 120, a protective cover 130, an air flow space S, and an air vent 150, 250, or 350.

The light source unit 110 may be a light-emitting source which generates light when power is applied. As an example, the light source unit 110 may include a circuit board 112 and one or more light sources 111 mounted on the circuit board 112. In this case, the light source unit 110 may include the circuit board 112 having a plate shape with a certain area, and may be a flat plate shape in which one or more light sources 111 are mounted on the circuit board 112.

In the present invention, the light source may be a known LED 111. In addition, the light source unit 110 may be implemented as a surface light source in which a plurality of LEDs 111 are disposed in a certain pattern on one surface of the circuit board 112. Furthermore, the circuit board 112 may be a printed circuit board which has a circuit pattern formed on at least one surface thereof, and the printed circuit board may be a flexible circuit board or a rigid circuit board. The circuit board 112 may be a metal printed circuit board (PCB) such that heat generated from the LED 111 may be smoothly transferred to the heat sink 120.

The circuit board 112 may be electrically connected to a connector 113, and thus, the above-described light source unit 110 may receive external power through the connector 113. Here, the connector 113 may be electrically connected to an external power source through a cable C. A longitudinally middle portion of the cable C may pass through a cable insertion hole 125 formed to pass through the heat sink 120, and thus, the cable C may be connected to the connector 113.

In this case, in the light source unit 110, one surface of the circuit board 112 may be fixed to one surface of the heat sink 120. As an example, the circuit board 112 may be attached to one surface of the heat sink 120 through an adhesive layer or may be detachably fixed to the heat sink 120 through a coupling member.

The heat sink 120 may support the light source unit 110 and may receive heat generated from the light source unit 110 to discharge the heat to the outside. To this end, the heat sink 120 may include a plate-shaped base substrate 121 having a certain area to support the light source unit 110, and the base substrate 121 may be made of a material having an excellent heat radiation property.

Accordingly, the base substrate 121 may effectively radiate heat generated from the light source unit 110 while supporting the light source unit 110. As an example, the base substrate 121 may be made of a metal material having excellent thermal conductivity, such as aluminum or copper.

Thus, in the LED modules 100, 200, or 300 according to one embodiment of the present invention, heat generated when the LED 111 emits light may be transferred to the heat sink 120 and then may be radiated to the outside, thereby preventing a decrease in light efficiency caused by degradation and extending a lifespan of an LED product.

In this case, the heat sink 120 may include one or more heat radiation fins 122 formed to protrude in one direction from the base substrate 121. The heat radiation fin 122 may have a plate shape to widen a contact area with the outside air.

In addition, in order to further widen the contact area with the outside air, the heat radiation fin 122 may have one or more protrusions 123 formed to protrude from a surface thereof. As an example, the protrusion 123 may protrude in a direction parallel to a width direction of the heat radiation fin 122 to have a certain length. A plurality of protrusions 123 may be formed in a height direction of the heat radiation fin 122. In this case, the plurality of protrusions 123 may be formed to be parallel with adjacent protrusions 123.

However, a shape of the protrusion 123 may include, but is not limited to, any known pattern such as a grid pattern or an inclined pattern as long as the pattern may widen the contact area with the outside air.

Meanwhile, other materials other than a metal material having an excellent heat radiation property may also be used as a material of the base substrate 121. That is, any plate-shaped member without limitation as long as the plate-shaped member has a heat radiation property may be used as the material of the base substrate 121. As a part thereof, the base substrate 121 may be made of only a known heat radiation plastic material or may be formed in a form in which a metal material and heat radiation plastic are integrated through insert molding.

In a specific example, the base substrate 121 may be heat radiation plastic made of a heat radiation member-forming component including a graphite composite and polymer resin.

In addition, the base substrate 121 may be formed in a form in which a metal plate with a certain area and the heat radiation plastic made of the heat radiation member-forming component are integrated through insert injection molding. In this case, the metal plate may have a shape which is completely embedded in the heat radiation plastic made of the heat radiation member-forming component or may have a shape of which one surface, to which the light source unit 110 is fixed, is exposed to the outside.

In this case, the graphite composite may be formed as a composite in which nano-metal particles are bonded to a surface of plate-shaped graphite. The nano-metal particles may be conductive metals to exhibit an electromagnetic shielding effect. The graphite composite may also include a catecholamine layer surrounding the nano-metal particles.

In addition, in a case in which the graphite composite includes the catecholamine layer surrounding the nano-metal particles, for example, a polydopamine layer, the graphite composite may be included in the heat radiation member-forming component in an amount of 50 wt % to 80 wt % to the total weight of the heat radiation member-forming component.

Meanwhile, the LED modules 100, 200, or 300 according to one embodiment of the present invention may include an insulating heat radiation coating layer 126 to prevent an electrical short circuit while implementing a more excellent heat radiation property. That is, the insulating heat radiation coating layer 126 may be formed to surround an outer surface of the base substrate 121.

Thus, in the LED modules 100, 200, or 300 according to one embodiment of the present invention, a more excellent heat radiation property may be implemented through the insulating heat radiation coating layer 126, and thus, even when the total number of the heat radiation fins 122 protruding from the base substrate 121 is reduced or the heat radiation fins 122 are formed to have a small area, it is possible to secure a heat radiation property higher than or equal to a level of a conventional case.

Accordingly, in the LED modules 100, 200, or 300 according to one embodiment of the present invention, the number of usages or formation area of the heat radiation fins 122 included in the heat sink 120 may be reduced, thereby implementing a heat radiation property higher than or equal to a level of a conventional case while reducing overall weight.

In addition, even when the LED module 100, 200, or 300 according to one embodiment of the present invention are used for outdoor lights, it is possible to secure an insulating property through the insulating heat radiation coating layer 126, thereby considerably reducing a probability of an electrical short circuit caused by an external environment such as rainwater in case of rain. Therefore, the LED modules 100, 200, or 300 according to one embodiment of the present invention may be stably operated. Even when the base substrate 121 is made of a metal material having electrical conductivity, it is possible to secure electrical stability and reliability.

The insulating heat radiation coating layer 126 will be described in detail below.

The protective cover 130 may cover the light source unit 110 disposed on one surface of the heat sink 120 to protect the light source unit 110 from an external environment.

Figure 3:
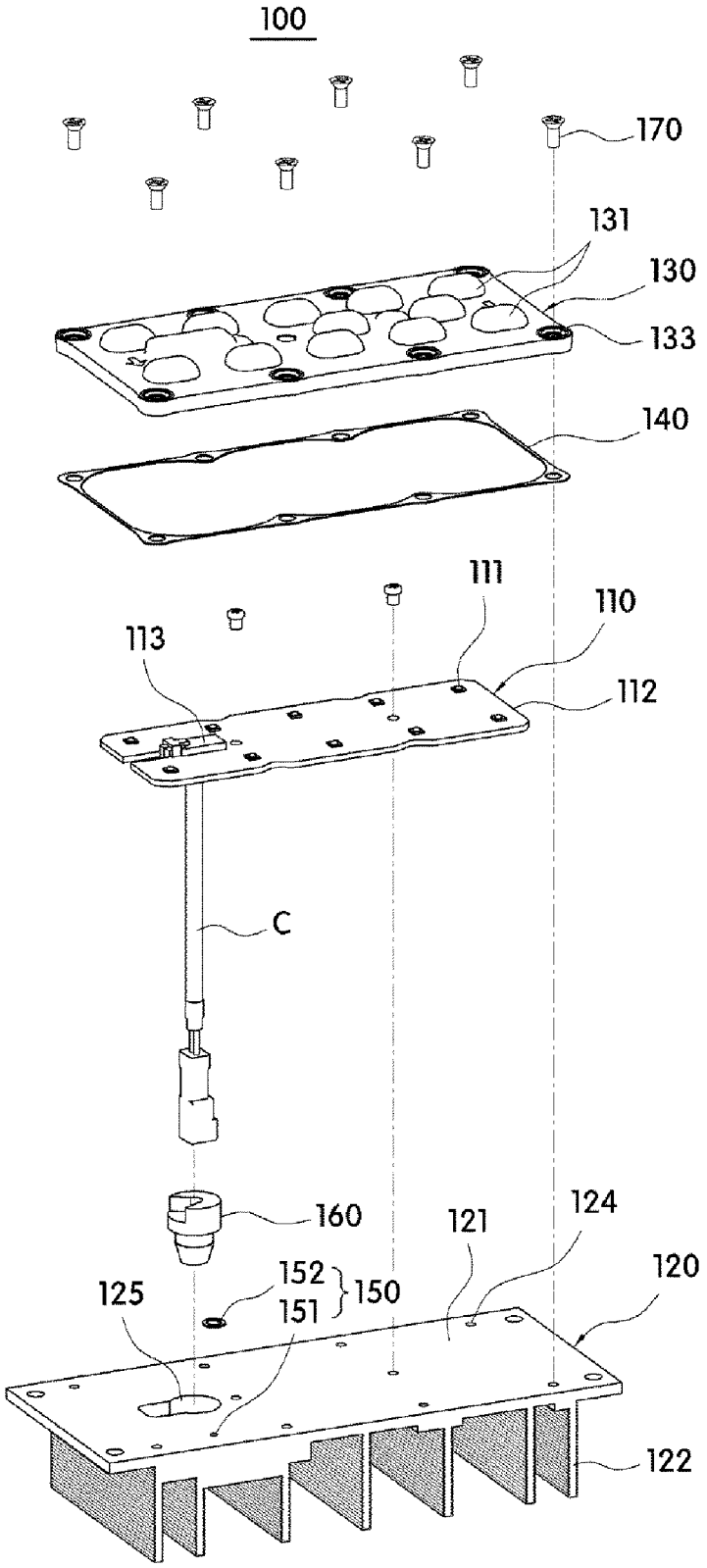
FIG. 3 is an exploded view of FIG. 1.
Figure 10:
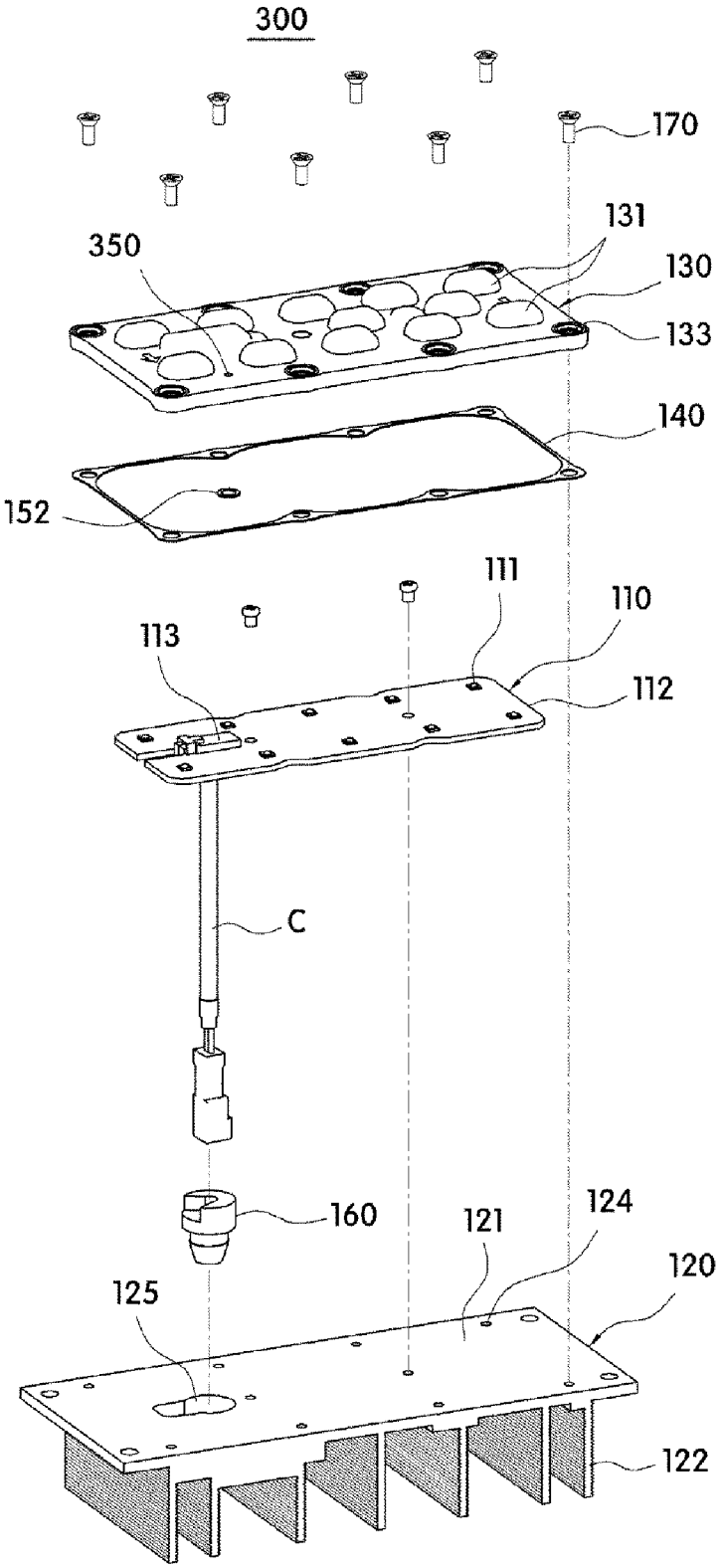
FIG. 10 is an exploded view of FIG. 9.

The protective cover 130 may be detachably coupled to one surface of the heat sink 120. To this end, as shown in FIGS. 3, 6, and 10, the heat sink 120 and the protective cover 130 may include one or more coupling holes 124 and 133 formed to pass through positions thereof corresponding to each other such that a coupling member 170 passes through the coupling holes 124 and 133. Accordingly, the protective cover 130 may be detachably coupled to the heat sink 120 through the coupling member 170.

Here, the coupling member 170 may be fixed by screw portions formed on inner surfaces of the coupling holes 124 and 133 through a screw coupling method or may be fixed through a fixing member such as a separate nut member coupled to one side of the coupling member 170.

In addition, in order to improve airtightness, a sealing member 140 such as an O-ring may be disposed at an edge in contact with the protective cover 130. As a result, in the LED modules 100, 200, or 300 according to one embodiment of the present invention, when the protective cover 130 and the heat sink 120 are coupled to each other through the coupling member 170, the sealing member 140 may prevent water from being introduced through a gap between the protective cover 130 and the heat sink 120 which are coupled.

In this case, the protective cover 130 may include a convex portion 131 which is convexly formed upward in a region corresponding to the LED 111. An accommodation space 132 for accommodating the LED 111 may be formed to be recessed from a facing surface of the convex portion 131 which faces the LED 111.

Thus, when the protective cover 130 is coupled to the heat sink 120, a protrusion height of the LED 111 may be accommodated in the accommodation space 132 even when the LED 111 protrudes from the circuit board 112 by a certain height. Accordingly, an edge of the protective cover 130 may be smoothly in close contact with the heat sink 120.

In the present invention, when the light source unit 110 includes the plurality of LEDs 111, a plurality of convex portions 131 of the protective cover 130 may be formed to correspond to the plurality of LEDs 111. In this case, a plurality of accommodation spaces 132 for accommodating the plurality of LEDs 111 may communicate with each other through the air flow space S formed between the protective cover 130 and the heat sink 120 facing each other.

To this end, in order for the air flow space S to be formed when the protective cover 130 is coupled to the heat sink 120, the protective cover 130 may include one or more protrusions 134 for maintaining an interval between the protective cover 130 and the circuit board 112. The protrusion 134 may be formed to protrude from one surface of the protective cover 130, and more specifically, from one surface of the protective cover 130 facing the heat sink 120. Accordingly, the air flow space S through which air may be moved due to the protrusion 134 may be formed between one surface of the protective cover 130 and one surface of the heat sink 120 facing each other, and thus, the plurality of accommodation spaces 132 may communicate with each other.

Figure 4:
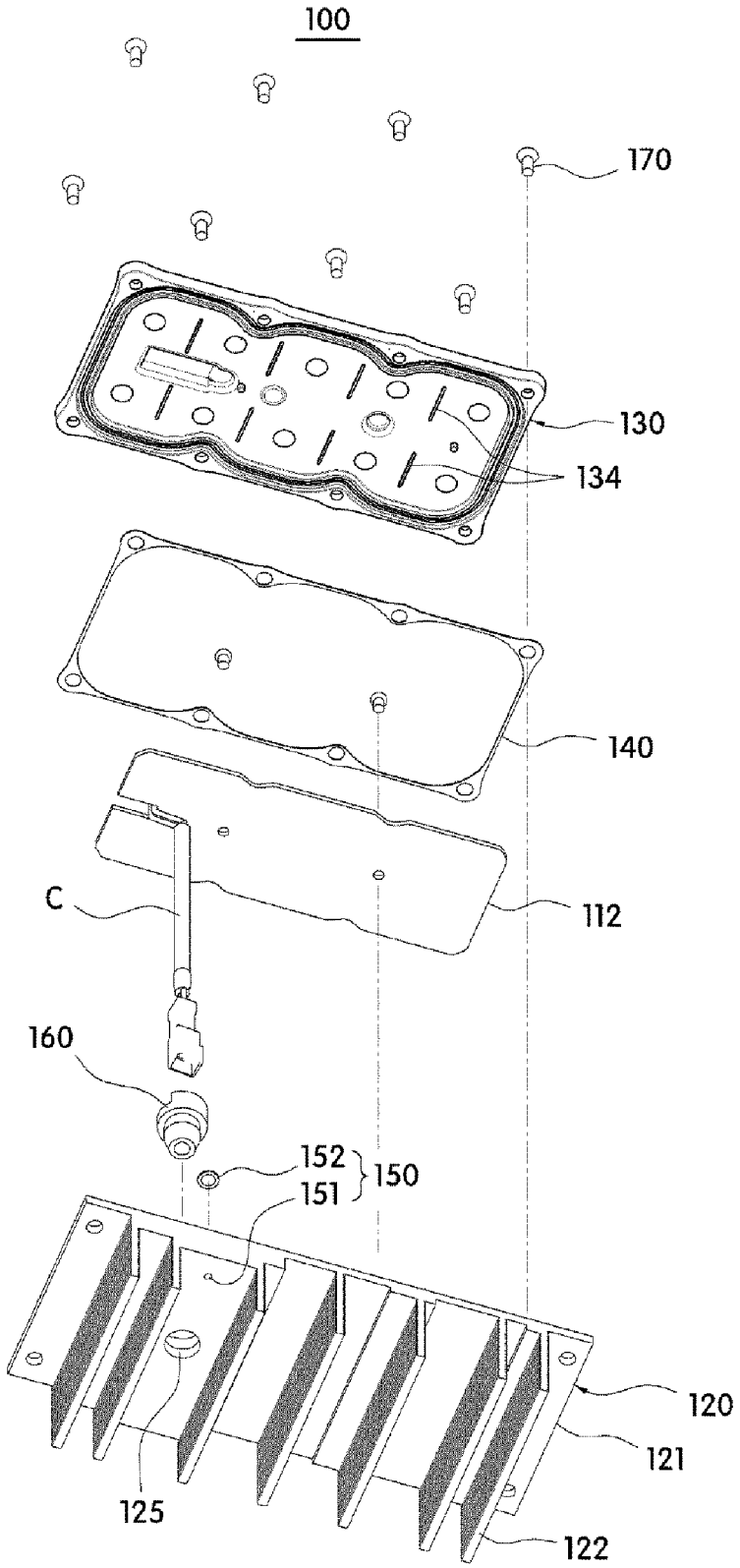
FIG. 4 is a bottom view of FIG. 3.
Figure 5:
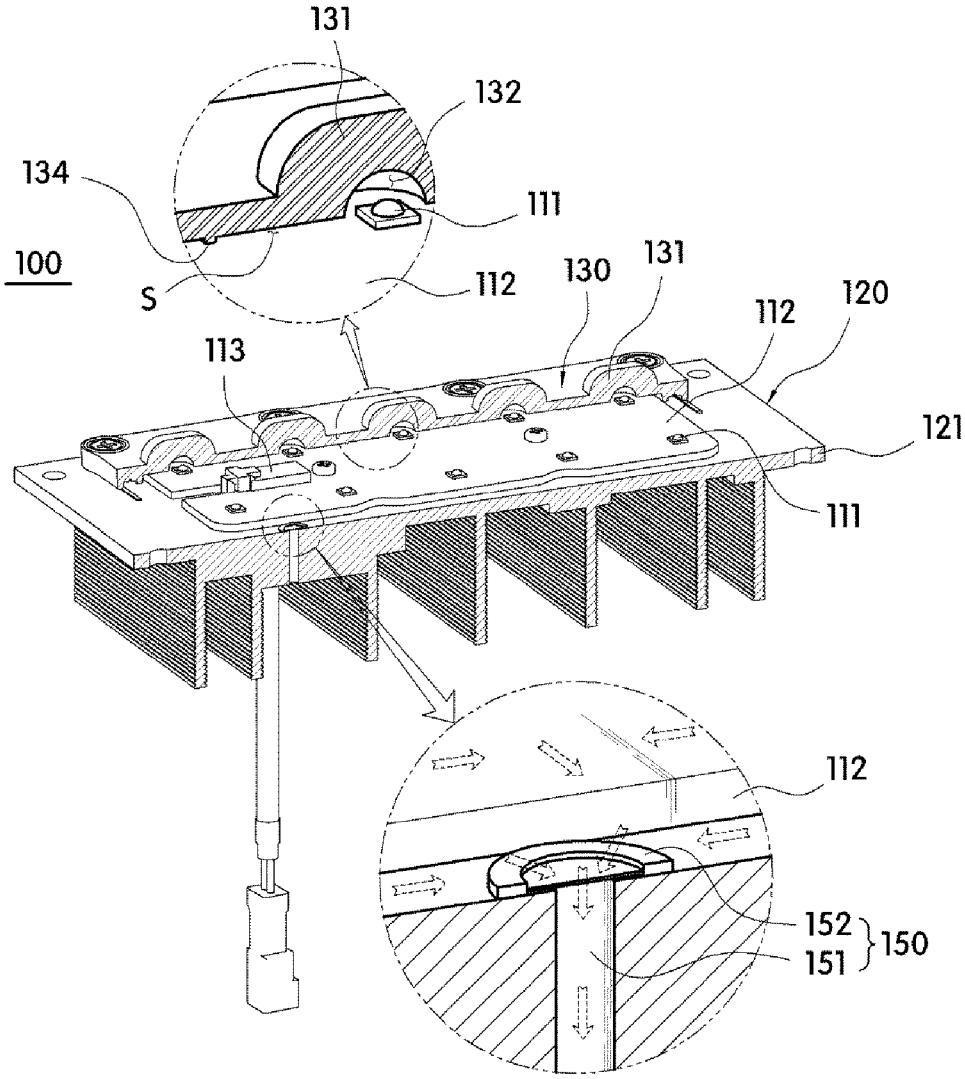
FIG. 5 shows cut-out views illustrating portions of a protective cover and a heat sink of FIG. 1.

In an example, as shown in FIG. 4, the protrusion 134 may be provided in a bar shape having a certain length. The protrusion 134 may have a length relatively less than the total width or length of the protective cover 130.

In addition, a plurality of protrusions 134 may be provided and may be spaced a certain distance apart from each other. However, a shape of the protrusion 134 may include, but is not limited to, a dot shape. Any shape may be applied as the shape of the protrusion 134 as long as the shape may form a certain interval between the circuit board 112 and the protective cover 130 facing each other.

The air vent 150, 250, or 350 may serve as a passage through which air present in the air flow space S is moved to the outside. Thus, internal pressure of the air flow space S may be balanced with external pressure.

Specifically, the air present in the accommodation space 132 may be heated by heat generated when the LED 111 emits light, and the heated air flows along the air flow space S. Air heated in each accommodation space 132 by heat generated by the LED 111 may be moved and meet through the air flow space S. Through such convection of air, after a certain period of time, all the air present in the plurality of accommodation spaces 132 and the air flow space S may be changed to a heated state.

In this case, in order to maintain a balance, a volume of the air heated in the accommodation spaces 132 and the air flow space S may be increased, and thus, pressure thereof may be lowered.

When a temperature of the air present in the accommodation space 132 and the air flow space S is increased through such a process and the accommodation spaces 132 and the air flow space S communicating with each other are completely sealed, the volume of the heated air may be increased, and thus internal pressure of the accommodation spaces 132 and the air flow space S may be increased. Accordingly, the internal pressure increased through the increase in temperature of the air acts as an external force that pushes a weak portion of portions coupled to each other, thereby weakening durability of the portions coupled to each other.

In particular, when the sealing member 140 made of a rubber material is disposed between the protective cover 130 and the heat sink 120 to increase airtightness, since strength of the sealing member 140 is low due to material properties thereof, the sealing member 140 may be deformed by the increased internal pressure. Accordingly, the sealing member 140 may be repeatedly deformed according to whether the light source unit 110 is operated. That is, the sealing member 140 may be deformed due to pressure increased when the light source unit 110 is operated and may be restored to its original state due to decrease in the internal pressure when the light source unit 110 is not operated.

As a result, the sealing member 140 may not maintain the original airtightness when a restoring force thereof is lost due to stress generated during repeated deformation and restoration.

In the present invention, air present in the accommodation spaces 132 and the air flow space S may be discharged to the outside through the air vent 150, 250, or 350. Thus, even when the temperature of the air present in the accommodation spaces 132 and the air flow space S is changed, the internal pressure of the accommodation spaces 132 and the air flow space S may be flexibly changed in response to a change in temperature of the air. Thus, the internal pressure of the accommodation spaces 132 and the air flow space S may always be balanced with external pressure.

To this end, the air vent 150, 250, or 350 may include a movement path 151 formed to be perforated so as to communicate with the air flow space S and a vent member 152 configured to cover an open end of the movement path 151.

In this case, the vent member 152 may be a membrane having air permeability and moisture permeability, and the membrane may be made of a nanofiber agglomerate. Accordingly, in the LED modules 100, 200, or 300 according to one embodiment of the present invention, air may be freely flowing in and out through the vent member 152, and thus, the internal pressure of the air flow space S may be balanced with the external pressure. In addition, in the LED modules 100, 200, or 300 according to one embodiment of the present invention, water may be prevented from entering the air flow space S from the outside through the vent member 152, thereby preventing oxidation of electronic components caused by permeation of water such as moisture and also discharging water vapor present in the air flow space S to the outside. Accordingly, it is possible to prevent condensation that may occur on a surface of the protective cover 130.

In the present invention, the nanofiber agglomerate having air permeability and moisture permeability has been described as an example of the vent member 152, but is not limited to, any material typically used to discharge inside air to the outside may be used as the vent member 152.

Meanwhile, one air vent 150, 250, or 350 is shown in the drawings as being provided, but the present is not limited thereto. One or more air vents 150, 250, or 350 may be provided so as to communicate with the air flow space S. In addition, when the air flow space S is provided with a plurality of spaces separated from each other, the air vent 150, 250, or 350 may be provided with a number matching at least one to one with the plurality of spaces separated from each other. In addition, the installation position and installation number of the air vents 150, 250, or 350 may be appropriately changed according to design conditions.

In a specific example, as shown in FIGS. 1 to 5, the air vent 150 may be provided in the heat sink 120.

That is, the movement path 151 may be formed to pass through the heat sink 120 so as to communicate with the air flow space S, and the vent member 152 may be attached to one surface of the heat sink 120 to cover an open upper portion of the movement path 151.

In this case, the vent member 152 may have a relatively larger area than an area of the open end of the movement path 151. At least a portion of the movement path 151 may be formed at a position that does not overlap the circuit board 112.

Figure 7:
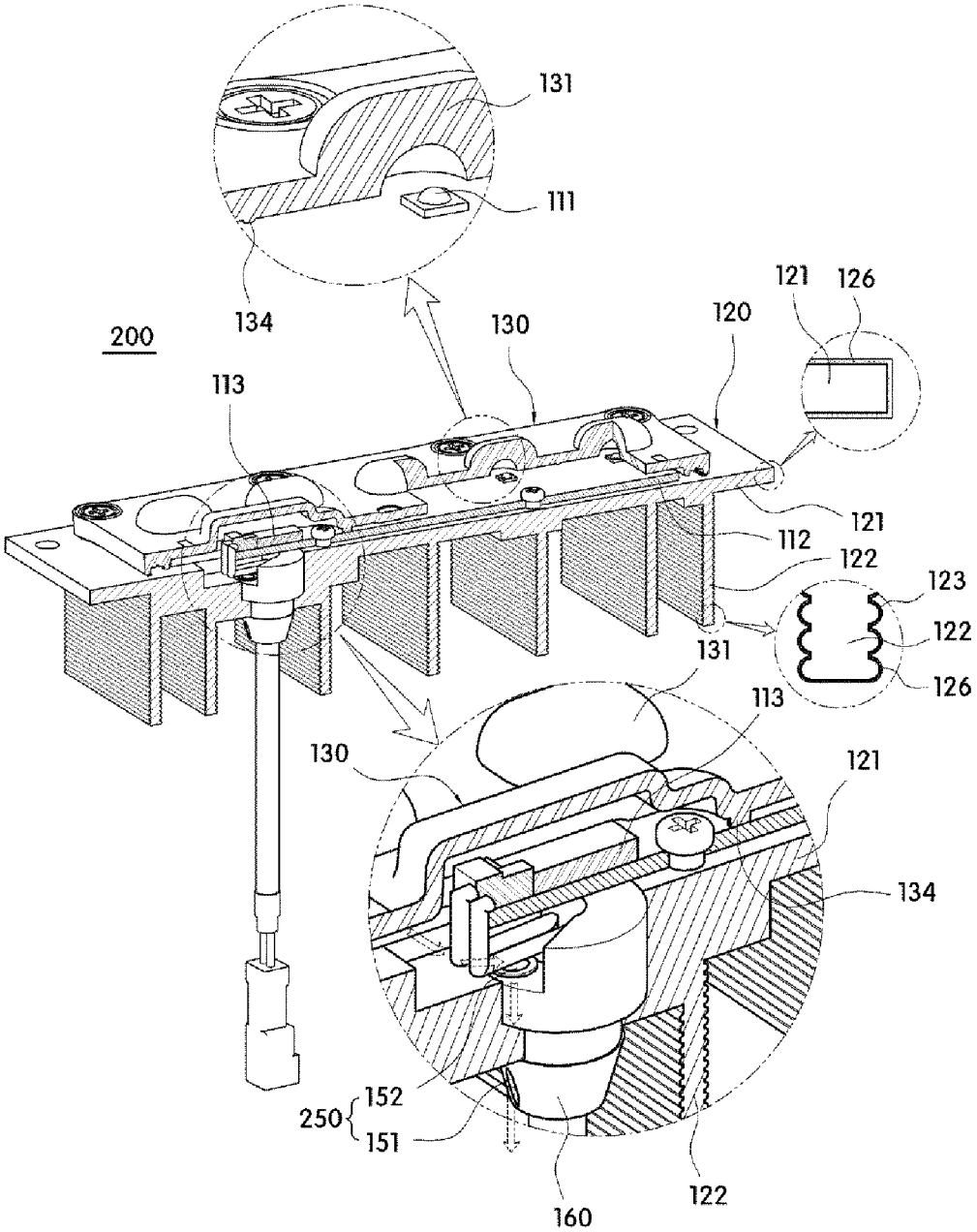
FIG. 7 shows cut-out views illustrating portions of a protective cover and a heat sink in a state in which the LED module of FIG. 6 is coupled.
Figure 8:
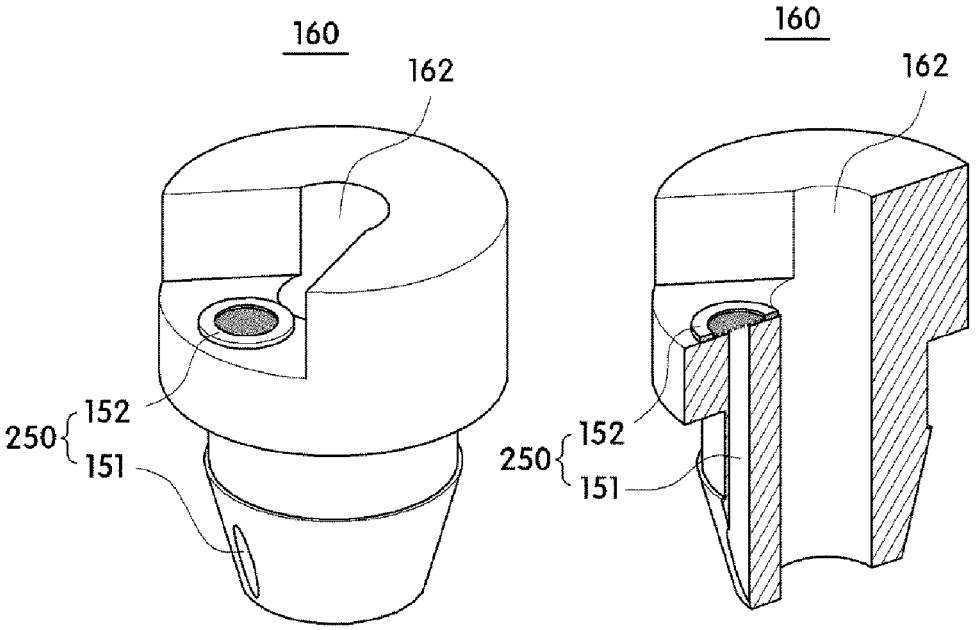
FIG. 8 shows a perspective view illustrating a cable fixture applied to FIG. 6 and a view illustrating a state in which a portion of the cable fixture is cut out.

In another example, as shown in FIGS. 6 to 8, the air vent 250 may be provided in a cable fixture 160 coupled to the heat sink 120.

That is, the movement path 151 may be formed to pass through the cable fixture 160 in a height direction of the cable fixture 160 so as to communicate with the air flow space S, and the vent member 152 may be attached to one surface of the cable fixture 160 to cover an open end of the movement path 151.

Here, the cable fixture 160 may have a through-hole 162 formed to pass therethrough along the height direction thereof. The cable C for electrically connecting an external power source to the connector 113 may be inserted into the through-hole 162. In addition, the cable fixture 160 may be inserted into the cable insertion hole 125 formed in the heat sink 120. The above-described cable fixture 160 may perform both a function of fixing the cable C and a function as a sealing member configured to prevent external water from entering the light source unit 110.

In this case, in comparison with the above-described one embodiment, since a separate process of changing the heat sink 120 itself or forming the movement path 151 is unnecessary, it is possible to increase reliability and productivity of a product.

Figure 11:
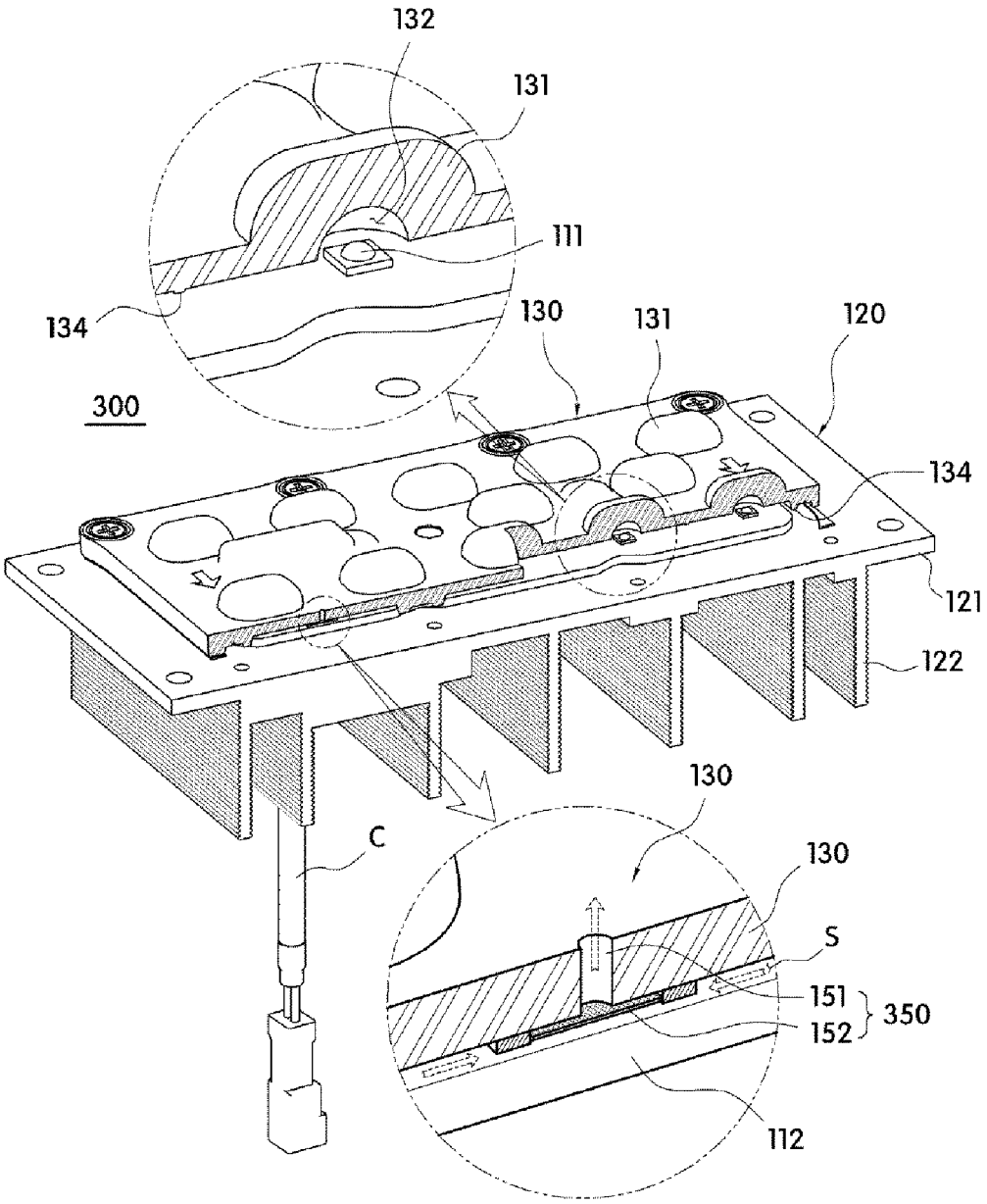
FIG. 11 is a cut-out view illustrating a portion of a protective cover of FIG. 9.

In still another example, as shown in FIGS. 9 to 11, the air vent 350 may be provided in the protective cover 130.

That is, the movement path 151 may be formed to pass through the protective cover 130 so as to communicate with the air flow space S, and the vent member 152 may be attached to an inner surface of the protective cover 130 to cover an open end of the movement path 151.

Meanwhile, the insulating heat radiation coating layer 126 covering the surface of the heat sink 120 may include a coating layer-forming component including a main resin and an insulating heat radiation filler. In this case, the insulating heat radiation filler may be included in an amount of 25 to 70 parts by weight with respect to 100 parts by weight of the main resin.

Here, the main resin is for forming a coating layer, and may be used without limitation as long as the component is capable of forming a coating layer and is known in the art.

However, in order to improve adhesion to the base substrate 121, a heat resistance property so as to not be embrittled by heat, an insulating property so as to not be embrittled by electrical stimulation, mechanical strength, heat radiation performance according to improvement in compatibility with the insulating heat radiation filler, and dispersibility of the heat radiation filler, the main resin may include epoxy resin. As a non-limiting example, the epoxy resin may be epoxy resin including at least one selected from the group consisting of glycidyl ether type epoxy resin, glycidylamine type epoxy resin, glycidyl ester type epoxy resin, linear aliphatic type epoxy resin, rubber-modified epoxy resin, and derivatives thereof.

In consideration of a heat radiation property, improvement in durability and surface quality of the insulating heat radiation coating layer, and improvement in dispersibility of the heat radiation filler, the main resin may include a compound having high compatibility with the insulating heat radiation filler to be described below, in particular, silicon carbide.

In addition, the coating layer-forming component may include a curing agent in addition to the above-described epoxy resin usable as the main resin. The curing agent may be appropriately used according to a type of selectable epoxy resin. As an example, the curing agent may be a curing agent known in the art and, preferably, may include at least one component selected from an aliphatic polyamine-based curing agent, an aromatic polyamine-based curing agent, an acid anhydride-based curing agent, and a catalyst-based curing agent.

Meanwhile, the curing agent of the coating layer-forming component may include a first curing agent and a second curing agent. In this case, the first curing agent may include an aliphatic polyamine-based curing agent and the second curing agent may include at least one selected from the group consisting of an aromatic polyamine-based curing agent, an acid anhydride-based curing agent, and a catalyst-based curing agent.

As a result, the curing agent may be very advantageous for improving compatibility with the insulating heat radiation filler to be described below, in particular, silicon carbide. In addition, the curing agent may be advantageous in terms of all physical properties such as adhesion, durability, and surface quality of the insulating heat radiation coating layer. Furthermore, even when a surface to be adhered, on which the heat radiation coating composition is applied, is a curved portion or a stepped portion rather than a flat portion, the curing agent may prevent cracks from being generated in the insulating heat radiation coating layer and prevent the insulating heat radiation coating layer from being peeled off from the surface to be adhered.

In this case, the curing agent may include the first curing agent and the second curing agent in a weight ratio of 1:0.5 to 1:1.5, and preferably, in a weight ratio of 1:0.6 to 1:1.4. Thus, the insulating heat radiation coating layer may exhibit further improved physical properties.

When the weight ratio of the first curing agent to the second curing agent is less than 1:0.5, adhesion strength to the base substrate 121 may be weakened. When the weight ratio of the first curing agent to the second curing agent exceeds 1:1.4, elasticity and durability of a coating film may be decreased.

In addition, the coating layer-forming component may include 25 to 100 parts by weight of the curing agent and preferably 40 to 80 parts by weight of the curing agent with respect to 100 parts by weight of the main resin.

When the curing agent is included in an amount less than 25 parts by weight with respect to 100 parts by weight of the main resin, a resin may be uncured or durability of a formed insulating heat radiation coating layer may be decreased. In addition, when the curing agent is included in an amount exceeding 100 parts by weight with respect to 100 parts by weight of the main resin, cracks may be generated in the formed insulating heat radiation coating layer or the insulating heat radiation coating layer may be broken.

Meanwhile, any material may be used as the material of the insulating heat radiation filler without limitation as long as the material has both of an insulating property and a heat radiation property. In addition, the shape or size of the insulating heat radiation filler are not limited. The insulating heat radiation filler may be porous or non-porous and may be appropriately selected according to a purpose thereof.

As an example, the insulating heat radiation filler may include at least one selected from the group consisting of silicon carbide, magnesium oxide, titanium dioxide, aluminum nitride, silicon nitride, boron nitride, aluminum oxide, silica, zinc oxide, barium titanate, strontium titanate, beryllium oxide, manganese oxide, zirconia oxide, and boron oxide.

In order to facilitate achievement of desired physical properties such as excellent insulating and heat radiation performance, ease of formation of the insulating heat radiation coating layer, uniform insulating and heat radiation performance after the insulating heat radiation coating layer is formed, and surface quality of the insulating heat radiation coating layer, the insulating heat radiation filler may be silicon carbide.

In addition, the insulating heat radiation filler may be a filler of which a surface is modified by using a functional group such as a silane group, an amino group, an amine group, a hydroxyl group, or a carboxyl group. In this case, the functional group may be directly bonded to the surface of the filler or may be indirectly bonded to the filler through $C_1$-$C_{20}$ substituted or unsubstituted aliphatic hydrocarbon or $C_6$-$C_{14}$ substituted or unsubstituted aromatic hydrocarbon.

In addition, the insulating heat radiation filler may be a core-shell type filler in which a known conductive heat radiation filler such as a carbon or metal-based material is used as a core and an insulating component surrounds the core.

Meanwhile, the insulating heat radiation filler may have an average particle diameter ranging from 10 nm to 15 μm, and preferably, an average particle diameter ranging from 30 nm to 12 μm. When the average particle diameter of the insulating heat radiation filler is less than 10 nm, product unit costs may be increased and after the insulating heat radiation filler is formed into an insulating heat radiation coating layer, an amount of the insulating heat radiation filler emerging on a surface of the insulating heat radiation coating layer may be increased, thereby decreasing heat radiation performance. In addition, when the average particle diameter of the insulating heat radiation filler exceeds 15 μm, uniformity of a surface may be decreased.

Meanwhile, in order to improve dispersibility, a D50 to D97 ratio of the heat insulating heat radiation filler may be 1:4.5 or less, and preferably, in a range of 1:1.2 to 1:3.5. When the D50 to D97 ratio exceeds 1:4.5, uniformity of a surface may be decreased, and a heat radiation effect may not appear uniformly because dispersibility of the heat radiation filler is low. In this case, since the insulating heat radiation filler includes particles having relatively large particle diameters, thermal conductivity may be relatively high, but desired heat radiation properties may not be implemented.

Here, the D50 and D97 mean particle diameters of the insulating heat radiation filler when cumulative degrees in a volume accumulated particle size distribution are 50% and 97%, respectively. Specifically, in a graph (particle size distribution based on a volume) in which a particle diameter is shown on a horizontal axis and a volume cumulative frequency is shown on a vertical axis from the smallest particle diameter, D50 and D97 mean particle diameters of particles of which volume cumulative values (%) from the smallest particle diameter are respectively 50% and 97% of a volume cumulative value (100%) of the total particles. The volume cumulative particle size distribution of the insulating heat radiation filler may be measured using a laser diffraction scattering particle size distribution device.

Meanwhile, the average particle diameter of the insulating heat radiation filler may be changed according to a thickness of a coating film of an insulating heat radiation coating layer. As an example, when the insulating heat radiation coating layer is formed to have a thickness of 25 μm, the insulating heat radiation filler may have an average particle diameter of 1 μm to 7 μm. When the insulating heat radiation coating layer is formed to have a thickness of 35 μm, the insulating heat radiation filler may have an average particle diameter of 8 μm to 12 μm. However, in order to further improve dispersibility of a heat radiation filler in a composition, an insulating heat radiation filler, which satisfies both the average particle diameter range and the ratio range of D50 to D97 of the above-described heat radiation filler, may be used.

In addition, the insulating heat radiation coating composition may further include a physical property-improving component. When the insulating heat radiation coating layer 126 is applied on the base substrate 121, the physical property-improving component may improve an insulating property and a heat radiation property and also may allow excellent adhesion to be exhibited, thereby improving durability. The physical property-improving component may be a silane-based compound, and known silane-based compounds applied in the art may be used without limitation.

Meanwhile, the above-described insulating heat radiation coating composition may include a colorant for minimizing a loss of color due to light, air, water, or extreme temperature and may further include a quencher for implementing stability of a coating film surface. In addition, the insulating heat radiation coating composition may further include a flame retardant to improve flame retardancy.

Furthermore, in order to improve dispersibility of the insulating heat radiation filler and implement a uniform coating layer, the above-described insulating heat radiation coating composition may include a dispersant and a solvent, and may further include an ultraviolet (UV) stabilizer for preventing yellowing by a UV ray.

Furthermore, the above-described insulating heat radiation coating composition may further include an antioxidant for preventing discoloration of a coating dry film, embrittlement due to oxidation, and a reduction in physical properties such as adhesive strength.

In addition, the above-described insulating heat radiation coating composition may include at least one type selected from various additives such as a leveling agent, a pH adjusting agent, an ion trapping agent, a viscosity modifier, a thixotropic agent, an antioxidant, a heat stabilizer, a photostabilizer, an ultraviolet absorber, a colorant, a dehydrating agent, a flame retardant, an antistatic agent, an antifungal agent, and a preservative.

The present invention will be described in more detail through the following examples, however, the following examples do not limit the scope of the present invention, and it should be understood that the following examples are intended to assist the understanding of the present invention.

Example 1

An insulating heat radiation coating composition included 60 parts by weight of a curing agent with respect to 100 parts by weight of a main resin, i.e., a compound represented by Formula 1 below. In this case, the curing agent includes polyethylene polyamine as a first curing agent and 2,4,6-tris[[N, N-dimethylamino]methyl]phenol as a second curing agent at a weight ratio of 1:1. In addition, the insulating heat radiation coating composition included 47 parts by weight of silicon carbide having an average particle diameter of 5 μm and a D50 to D97 ratio of 1:1.6 as insulating heat radiation filler. In addition, in the insulating heat radiation coating composition, 3 parts by weight of an epoxy-based silane compound as a physical property-improving component (Tech-7130 manufactured by Shanghai Tech Polymer Technology), 44 parts by weight of talc as a colorant, 44 parts by weight of titanium dioxide as a quencher, 22 parts by weight of trizinc bis(orthophosphate) as a flame retardant, 0.5 parts by weight of 2-(2'-hydroxy-3,5'-di(1,1-dimethylbenzyl)-phenyl)-benzotriazole as a UV stabilizer, 1 part by weight of 2-hydroxyphenyl benzothiazole as an antioxidant, 5 parts by weight of a condensate of isobutylaldehyde and urea as a dispersant, and solvents such as 13 parts by weight of 1-butanol, 13 parts by weight of n-butyl acetate, 13 parts by weight of 2-methoxy-1-methylethyl acetate, 9 parts by weight of methyl ethyl ketone, 37 parts by weight of ethyl acetate, 9 parts by weight of toluene, 43 parts by weight of 4-methyl-2-pentanone, and 103 parts by weight of xylene were mixed with the main resin, the curing agent, and the insulating heat radiation filler and was stirred to form a mixture. Bubbles included in the mixture were removed, and final viscosity was adjusted to 100 cps to 130 cps at a temperature of 25° C. to prepare the insulating heat radiation coating composition as shown in Table 1 below. Then, the insulating heat radiation coating composition was stored at a temperature of 5° C.

[Formula 1]

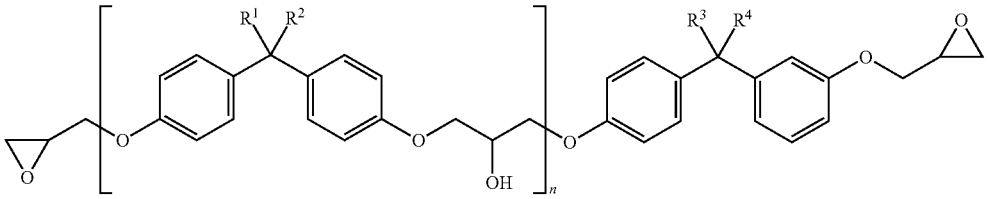

Each of R1 to R4 is a methyl group, and n is a rational number which allows a weight average molecular weight of the compound represented by Formula 1 to be 2,000.

Examples 2 to 13

Insulating heat radiation coating compositions were prepared in the same manner as in Example 1, except that an average particle diameter and a particle size distribution of an insulating heat radiation filler, a weight ratio of a curing agent, and the like were changed as shown in Table 1 and Table 2.

Comparative Examples 1 to 3

Insulating heat radiation coating compositions were prepared in the same manner as in Example 1, except that a content of an insulating heat radiation filler and the like were changed as shown in Table 3.

Experimental Example 1

Each of the heat radiation coating compositions prepared in Examples and Comparative Examples was spray-coated on a surface of a substrate made of an aluminum material (Al 1050) and having a thickness of 1.5 mm and an area having a length 35 and a width of 34 mm so as to have a final thickness of 25 μm. Then, the substrate having the surface coated with the heat radiation coating composition was heat-treated at a temperature of 150° C. for 10 minutes to manufacture a heat radiation unit in which an insulating heat radiation coating layer is formed. After that, the following physical properties were evaluated. Tables 1 to 3 below show result values for each evaluation item.

1. Evaluation of Thermal Conductivity

The heat radiation unit was placed at a center of an acrylic chamber having a length of 32 cm, a width of 30 cm, and a height of 30 cm, and then, a temperature inside the chamber and a temperature of the heat radiation unit were adjusted to 25±0.2° C. Then, an LED having a length 20 mm and a width of 20 mm as a heat source was attached to the heat radiation unit by using Thermal Interface Material (TIM, for example, thermal conductive tape: 1 W/mk), thereby manufacturing a test specimen. An input power of 2.1 W (DC 3.9 V and 0.53 A) was applied to the heat source of the manufactured test specimen to generate heat. After the test specimen was maintained for 90 minutes, a temperature of the heat radiation unit was measured to evaluate thermal conductivity. Specifically, thermal conductivity was calculated according to Expression 1 below based on a temperature measured with respect to a substrate not including a heat radiation coating layer under the same conditions.

thermal conductivity (%)={1−(temperature (° C.) of test specimen)/(temperature (° C.) of uncoated substrate)}×100(%) [Expression 1]

2. Evaluation of Heat Radiation Performance

The heat radiation unit was placed at a center of an acrylic chamber having a length of 32 cm, a width of 30 cm, and a height of 30 cm, and then, a temperature inside the chamber and a temperature of the heat radiation unit were adjusted to 25±0.2° C. Then, an LED having a length 20 mm and a width of 20 mm as a heat source was attached to the heat radiation unit by using Thermal Interface Material (TIM, for example, thermal conductive tape: 1 W/mk), thereby manufacturing a test specimen. An input power of 2.1 W (DC 3.9 V and 0.53 A) was applied to the heat source of the manufactured test specimen to generate heat. After the test specimen was maintained for 90 minutes, a temperature of an upper point located 5 cm from a center of the heat radiation unit was measured to evaluate heat emissivity. Specifically, heat emissivity was calculated according to Expression 2 below based on a temperature measured with respect to a substrate not including an insulating heat radiation coating layer under the same conditions.

heat radiation efficiency (%)={(temperature (° C.) of upper point located 5 cm from center of heat radiation unit)/(temperature (° C.) of upper point located 5 cm from center of uncoated heat radiation unit)−1}×100 [Expression 2]

3. Uniformity Evaluation of Heat Radiation Performance

The heat radiation unit was placed at a center of an acrylic chamber having a length of 32 cm, a width of 30 cm, and a height of 30 cm, and then, a temperature inside the chamber and a temperature of the heat radiation unit were adjusted to 25±0.2° C. Humidity inside the chamber was adjusted to 50%. Then, an LED having a length of 20 mm and a width of 20 mm as a heat source was attached to the heat radiation unit by using Thermal Interface Material (TIM, for example, thermal conductive tape: 1 W/mk), thereby manufacturing a test specimen. An input power of 2.1 W (DC 3.9 V and 0.53 A) was applied to the heat source of the manufactured test specimen to generate heat. After the specimen was maintained for 90 minutes, temperature was measured at each of any of 10 points on a 15 mm radius circle centered on a center of an upper surface of the heat radiation unit, and an error of the temperature was calculated according to Expression 3 below. As an error becomes smaller, it can be considered that heat radiation performance is uniform, and it can be interpreted that dispersibility of a heat radiation filler of an insulating heat radiation coating layer is high. A maximum value of errors of a temperature was shown in Tables 1 to 3 below.

error (%) of temperature=[(average temperature (° C.) of any 10 points)−(temperature (° C.) of each point)]/(average temperature (° C.) of any 10 points)×100(%) [Expression 3]

4. Evaluation of Durability

The heat radiation unit was placed in a chamber having a temperature of 60° C. and a relative humidity of 90%, and then, after 480 hours, a surface state of the heat radiation unit was visually evaluated. As a result of evaluation, the presence or absence of cracking and peeling (lifting) of an insulating heat radiation coating layer was confirmed. When there was no abnormality, it was indicated as 0, and when there was an abnormality, it was indicated as X.

5. Evaluation of Adhesiveness

A specimen, on which durability was evaluated, was cross-cut at intervals of 1 mm by using a knife. After that, scotch tape was attached to a cut surface and was pulled at an angle of 60° to check a state in which an insulating heat radiation coating layer was peeled off. Evaluation was performed according to an evaluation criterion, i.e., ISO 2409. (5B: 0%, 4B: 5% or less, 3B: 5-15%, 2B: 15-35%, 1B: 35-65%, and 0B: 65% or more)

6. Evaluation of Surface Quality

In order to confirm a surface quality of the heat radiation unit, it was checked whether a surface was uneven or rough by touching the surface with a hand. When there was a smooth feeling, it was indicated as 5. When an area of a rough portion was less than or equal to 2% of the total area of an outer surface of the heat radiation unit, it was denoted as 4. When the area of the rough portion was greater than 2% and less than or equal to 5% of the total area, it was denoted as 3. When the area of the rough portion was greater than 5% and less than or equal to 10% of the total area, it was denoted as 2. When the area of the rough portion was greater than 10% and less than or equal to 20% of the total area, it was denoted as 1. When the area of the rough portion was greater than 20% of the total area, it was denoted as 0.

TABLE 1

| Category | | Example 1 | Example 2 | Example 3 | Example 4 | Example 5 | Example 6 | Example 7 |
|---|---|---|---|---|---|---|---|---|
| Coating layer-forming component | Main resin (weight average molecular weight) | 2,000 | 2,000 | 2,000 | 2,000 | 2,000 | 2,000 | 2,000 |
| | Content of curing agent (parts by weight) | 60 | 60 | 60 | 60 | 60 | 60 | 60 |
| | Weight ratio of first curing agent to second curing agent | 1:1 | 1:1 | 1:1 | 1:0.2 | 1:0.6 | 1:1.4 | 1:2 |
| Insulating heat radiation filler | Content (parts by weight) | 47 | 35 | 60 | 47 | 47 | 47 | 47 |
| | Average particle diameter (μm) | 5 | 5 | 5 | 5 | 5 | 5 | 5 |
| | Ratio of D50 to D97 | 1:1.6 | 1:1.6 | 1:1.6 | 1:1.6 | 1:1.6 | 1:1.6 | 1:1.6 |
| Heat radiation unit | Thickness (μm) of insulating heat radiation coating layer | 25 | 25 | 25 | 25 | 25 | 25 | 25 |
| | Thermal conductivity (%) | 18.27 | 17.65 | 18.34 | 16.94 | 17.72 | 17.63 | 17.01 |
| | Heat radiation efficiency (%) | 90 | 81 | 96 | 86 | 88 | 89 | 88 |
| | Error (%) of temperature | 0.5 | 0.6 | 0.4 | 0.5 | 0.5 | 0.5 | 0.5 |
| | Adhesiveness | 5B | 5B | 5B | 0B | 5B | 5B | 2B |
| | Durability | ○ | ○ | ○ | x | ○ | ○ | x |
| | Surface quality | 5 | 5 | 5 | 5 | 5 | 5 | 5 |

TABLE 2

| Category | | Example 8 | Example 9 | Example 10 | Example 11 | Example 12 | Example 13 |
|---|---|---|---|---|---|---|---|
| Coating layer-forming component | Main resin (weight average molecular weight) | 2,000 | 2,000 | 2,000 | 2,000 | 2,000 | 2,000 |
| | Content of curing agent (parts by weight) | 60 | 60 | 60 | 60 | 60 | 60 |
| | Weight ratio of first curing agent to second curing agent | 1:1 | 1:1 | 1:1 | 1:1 | 1:1 | 1:1 |
| Insulating heat radiation filler | Content (parts by weight) | 47 | 47 | 47 | 47 | 47 | 47 |
| | Average particle diameter (μm) | 0.005 | 0.42 | 10 | 20 | 3 | 5 |
| | Ratio of D50 to D97 | 1:2.41 | 1:2.08 | 1:1.51 | 1:193 | 1:3.08 | 1:4.96 |

TABLE 2-continued

| Category | | Example 8 | Example 9 | Example 10 | Example 11 | Example 12 | Example 13 |
|---|---|---|---|---|---|---|---|
| Heat radiation unit | Thickness (μm) of insulating heat radiation coating layer | 25 | 25 | 25 | 25 | 25 | 25 |
| | Thermal conductivity (%) | 12.11 | 17.63 | 17.92 | 17.19 | 17.88 | 18.31 |
| | Heat radiation efficiency (%) | 7 | 88 | 91 | 90 | 81 | 39 |
| | Error (%) of temperature | 0.5 | 0.5 | 0.4 | 2.8 | 0.8 | 3.9 |
| | Adhesiveness | 3B | 5B | 5B | 3B | 4B | 2B |
| | Durability | ○ | ○ | ○ | ○ | ○ | ○ |
| | Surface quality | 5 | 5 | 4 | 0 | 4 | 3 |

TABLE 3

| Category | | Comparative Example 1 | Comparative Example 2 | Comparative Example 3[1)] |
|---|---|---|---|---|
| Coating layer-forming component | Main resin (weight average molecular weight) | 2,000 | 2,000 | 2,000 |
| | Content of curing agent(parts by weight) | 60 | 60 | 60 |
| | Weight ratio of first curing agent to second curing agent | 1:1 | 1:1 | 1:1 |
| Insulating heat radiation filler | Content (parts by weight) | 15 | 80 | — |
| | Average particle diameter (μm) | 5 | 5 | — |
| | Ratio of D50 to D97 | 1:1.6 | 1:1.6 | — |
| Heat radiation unit | Thickness (μm) of insulating heat radiation coating layer | 25 | 25 | 25 |
| | Thermal conductivity (%) | 14.62 | 18.36 | 4.76 |
| | Heat radiation efficiency (%) | 8 | 98 | 2 |
| | Error (%) of temperature | 5.3 | 1.0 | 0 |
| | Adhesiveness | 5B | 3.8 | 5B |
| | Durability | ○ | x | ○ |
| | Surface quality | 5 | 1 | 5 |

[1)]Comparative Example 3 is a composition which does not include a heat radiation filler.

As can be seen from Tables 1 to 3 above, it can be confirmed that Examples 1, 5, and 6, in which a weight ratio of a first curing agent to a second curing agent is within a preferred range of the present invention, concurrently achieve adhesiveness and durability as compared with Examples 4 and 7 which do not satisfy the preferred range.

In addition, it can be confirmed that Examples 1, 9, and 10, in which an average particle diameter of an insulating heat radiation filler is within a preferred range of the present invention, concurrently achieve heat radiation efficiency, thermal conductivity, and surface quality as compared with Examples 8 and 11 which do not satisfy the preferred range.

Furthermore, it can be confirmed that Examples 1 and 12, in which a D50 to D97 ratio is within a preferred range of the present invention, concurrently achieve dispersibility, surface quality, heat radiation efficiency, and adhesiveness as compared with Example 13 which does not satisfy the preferred range.

In addition, it can be confirmed that Examples 1 to 3, in which a content of an insulating heat radiation filler is within a preferred range of the present invention, concurrently have considerably excellent heat radiation performance and surface quality as compared with Comparative Examples 1 and 2 which do not satisfy the preferred range.

Furthermore, it can be confirmed that Comparative Example 3 not including an insulating heat radiation filler has considerably low heat radiation performance as compared with Example 1.

The above-described LED modules 100, 200, and 300 according to one embodiment of the present invention may be installed in both indoor and outdoor locations in which lighting is required. As an example, the LED modules 100, 200, or 300 may be installed in an outdoor location such as a parking lot or a tunnel and may be used as a street light, a security light, a flood light, and a lighting lamp. The LED modules 100, 200, or 300 may also be used as an indoor light installed in an office or a residential space.

While one embodiment of the present invention has been described above, the present invention is not limited to the embodiment presented herein. One skilled in the art may easily suggest other embodiments due to addition, modification, deletion, and the like of components within the scope and spirit of the present invention, and the addition, modification, deletion, and the like of the components fall within the scope and spirit of the present invention.

The invention claimed is:

1. A light-emitting diode (LED) module comprising:

a light source unit which includes one or more LEDs mounted on one surface of a circuit board;

a heat sink which includes a base substrate configured to support the light source unit and radiate heat generated from the light source unit and an insulating heat radiation coating layer applied on an outer surface of the base substrate;

a protective cover which includes a convex portion formed in a region corresponding to the LED and is coupled to one surface of the heat sink to protect the light source unit from an external environment;

an air flow space which is formed between the light source unit and the protective cover; and one or more air vents which provide a passage between the air flow space and the outside, block a foreign substance and water from moving therethrough, and allow air to pass therethrough to balance internal pressure of the air flow space with pressure of outside air, wherein the light source unit is electrically connected to an external power source through a connector to which a cable is connected, a longitudinally middle portion of the cable is connected to a cable fixture detachably coupled to the heat sink, and the one or more air vents include a movement path formed to pass through the cable fixture and communicate with the air flow space and a vent member attached to one surface of the cable fixture to cover the movement path.

2. The LED module of claim 1, wherein the protective cover includes at least one protrusion configured to maintain a distance to the circuit board such that the air flow space is formed when the protective cover is coupled to the heat sink, and the protrusion is formed from one surface of the protective cover.

3. The LED module of claim 1, wherein the convex portion includes an accommodation space formed to accommodate the LED on a facing surface thereof which faces the LED, and the accommodation space communicates with the air flow space such that air heated by heat generated from the LED flows along the air flow space and then is discharged to the outside through the air vent.

4. The LED module of claim 1, wherein the air vent includes a movement path formed to pass through the heat sink and communicate with the air flow space and a vent member attached to one surface of the heat sink to cover an open upper portion of the movement path.

5. The LED module of claim 1, wherein the air vent includes a movement path formed to pass through the protective cover and communicate with the air flow space and a vent member attached to one surface of the protective cover to cover the movement path.

6. The LED module of claim 1, wherein the air vent includes a vent member made of a nanofiber agglomerate having air permeability and moisture permeability.

7. The LED module of claim 1, wherein the heat sink includes a plate-shaped heat radiation fin formed in one direction from the base substrate, and the heat radiation fin includes one or more protrusions formed on an outer surface thereof to widen a contact area with the outside air.

8. The LED module of claim 1, wherein the insulating heat radiation coating layer includes a coating layer-forming component including a main resin and an insulating heat radiation filler included in an amount ranging from 25 to 70 parts by weight with respect to 100 parts by weight of the main resin.

9. The LED module of claim 1, wherein the light source unit has a flat plate shape including the circuit board having a plate shape with a certain area and a plurality of LEDs mounted on one surface of the circuit board.

10. The LED module of claim 1, wherein the base substrate is made of a metal material.

11. The LED module of claim 4, wherein at least a portion of the air vent is disposed at a position that overlaps the circuit board and communicates with the air flow space.

12. The LED module of claim 8, wherein the insulating heat radiation filler includes silicon carbide.

13. The LED module of claim 8, wherein the insulating heat radiation filler has an average particle diameter of 10 nm to 15 μm and a ratio of D50 to D97 is 1:4.5 or less, wherein D50 and D97 mean particle diameters of the insulating heat radiation filler when cumulative degrees in a volume accumulated particle size distribution are 50% and 97%, respectively.

14. A light-emitting diode (LED) lighting device comprising:

a light source unit which includes one or more LEDs mounted on one surface of a circuit board;

a heat sink which includes a base substrate configured to support the light source unit and radiate heat generated from the light source unit and an insulating heat radiation coating layer applied on an outer surface of the base substrate;

a protective cover which includes a convex portion formed in a region corresponding to the LED and is coupled to one surface of the heat sink to protect the light source unit from an external environment;

an air flow space which is formed between the light source unit and the protective cover; and one or more air vents which provide a passage between the air flow space and the outside, block a foreign substance and water from moving therethrough, and allow air to pass therethrough to balance internal pressure of the air flow space with pressure of outside air, wherein the light source unit is electrically connected to an external power source through a connector to which a cable is connected, a longitudinally middle portion of the cable is connected to a cable fixture detachably coupled to the heat sink, and the one or more air vents include a movement path formed to pass through the cable fixture and communicate with the air flow space and a vent member attached to one surface of the cable fixture to cover the movement path.

* * * * *